US006532924B1

(12) United States Patent
Pierik

(10) Patent No.: US 6,532,924 B1
(45) Date of Patent: Mar. 18, 2003

(54) VARIABLE VALVE ACTUATING MECHANISM HAVING AUTOMATIC LASH ADJUSTMENT MEANS

(75) Inventor: Ronald J. Pierik, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/160,661

(22) Filed: May 31, 2002

Related U.S. Application Data

(63) Continuation-in-part of application No. 10/120,097, filed on Apr. 10, 2002.

(51) Int. Cl.[7] ..... F01L 1/18

(52) U.S. Cl. ..... 123/90.45; 123/90.12; 123/90.15; 123/90.16; 123/90.17; 123/90.27; 123/90.31; 123/90.39; 123/90.44; 74/559; 74/567; 74/569

(58) Field of Search ..... 123/90.15, 90.16, 123/90.17, 90.27, 90.31, 90.39, 90.43, 90.44, 90.45, 90.12, 90.6; 74/559, 567, 569

(56) References Cited

U.S. PATENT DOCUMENTS 5,251,586 A * 10/1993 Koga et al. ..... 123/90.16
5,452,694 A * 9/1995 Hara ..... 123/90.16
6,123,053 A * 9/2000 Hara et al. ..... 123/90.16
6,260,523 B1 * 7/2001 Nakamura et al. ..... 123/90.15
6,382,150 B1 * 5/2002 Fischer ..... 123/90.16
6,386,161 B2 * 5/2002 Pierik ..... 123/90.16
6,386,162 B2 * 5/2002 Himsel ..... 123/90.16
6,439,178 B1 * 8/2002 Pierik ..... 123/90.16

* cited by examiner

*Primary Examiner*—Thomas Denion
*Assistant Examiner*—Ching Chang
(74) *Attorney, Agent, or Firm*—Patrick M. Griffin

(57) ABSTRACT

A variable valve actuating mechanism includes an output cam pivotally disposed upon an input shaft. A first link arm is pivotally coupled at a first end thereof to the output cam. A rocker arm is pivotally coupled at a first end thereof to a second end of the link arm. A frame member is pivotally disposed upon the input shaft. Lash adjusting means include an eccentric pin and a force applying means. The eccentric pin pivotally couples together a first end of the frame member and a second end of the rocker arm. The force applying means applies a force upon the eccentric pin causing the eccentric pin to pivot which, in turn, adjusts the position of the rocker arm relative to the input shaft and thereby removes lash from the mechanism.

21 Claims, 3 Drawing Sheets

VARIABLE VALVE ACTUATING MECHANISM HAVING AUTOMATIC LASH ADJUSTMENT MEANS

CROSS-REFERENCE TO RELATED APPLICATION

This application is a continuation-in-part of U.S. patent application Ser. No. 10/120,097, filed Apr. 10, 2002.

TECHNICAL FIELD

The present invention relates to a variable valve actuating mechanism. More particularly, the present invention relates to a variable valve actuating mechanism having automatic lash adjustment.

BACKGROUND OF THE INVENTION

Modern internal combustion engines may incorporate advanced throttle control systems, such as, for example, intake valve throttle control systems, to improve fuel economy and performance. Generally, intake valve throttle control systems control the flow of gas and air into and out of the engine cylinders by varying the timing, duration and/or lift (i.e., the valve lift profile) of the cylinder valves in response to engine operating parameters, such as engine load, speed, and driver input. Intake valve throttle control systems vary the valve lift profile through the use of variously-configured mechanical and/or electromechanical devices, collectively referred to herein as variable valve actuation (VVA) mechanisms. Several examples of particular embodiments of VVA mechanisms are detailed in commonly assigned U.S. Pat. No. 5,937,809 and U.S. Pat. No. 6,019,076, the disclosures of which are incorporated herein by reference.

Generally, a conventional VVA mechanism includes a rocker arm that carries an input cam follower, such as a roller. The input cam follower engages an opening or input cam lobe of a rotating input shaft, such as the engine camshaft, and transfers rotation of the input cam lobe to oscillation of the rocker arm toward and away from the input shaft in a generally radial direction. The oscillation of the rocker arm is transferred via a link arm to pivotal oscillation of an output cam relative to the input shaft. The pivotal oscillation of the output cam is transferred to actuation of an associated valve by an output cam follower, such as, for example, a roller finger follower. The rocker arm also carries a closing cam follower, such as, for example, a slider pad, that engages a closing cam lobe of the rotary input shaft. The closing cam follower transfers rotation of the closing cam lobe to the rocker arm, thereby ensuring that the output cam is pivoted back or returned to its starting or base angular orientation.

A desired valve lift profile is obtained by pivoting a control shaft into a predetermined angular orientation relative to a centerline thereof. A frame member is pivotally disposed on the input shaft, and is coupled at one end thereof to the control shaft and at the other end thereof to the rocker arm. The pivotal movement of the control shaft is transferred, via the frame member, rocker arm and link arm, to pivotal movement of the output cam relative to a central axis of the input shaft. Thus, pivoting the control shaft places the output cam into the base or starting angular orientation. The base or starting angular orientation of the output cam, in turn, determines the portion of the lift profile thereof that will engage the output cam follower during pivotal oscillation of the output cam. The lift profile of the output cam that engages the cam follower determines the valve lift profile.

Conventional VVA mechanisms may also include a lash adjustment means. The lash adjustment means is adjusted during assembly of the VVA mechanism and/or engine to reduce mechanism lash, i.e., clearances between the cam followers and their corresponding cam lobes that are larger than intended, and thereby compensate for manufacturing tolerances and/or component dimensional variation. The adjustment of the lash adjustment means during assembly of the mechanism or engine is time consuming and labor intensive. Periodic adjustment of the lash adjustment means is typically required thereafter, such as, for example, to compensate for wear and tear of mechanism components. Such further adjustment requires a vehicle owner to return the vehicle to a service provider for periodic maintenance.

Therefore, what is needed in the art is a VVA mechanism having a lash adjustment means that reduces and/or eliminates the need for manual adjustment of lash during assembly and/or installation of the VVA mechanism.

Furthermore, what is needed in the art is a VVA mechanism having a lash adjustment means that substantially reduces the need for periodic adjustment/maintenance to reduce/remove the lash from the VVA mechanism.

Still further, what is needed in the art is VVA mechanism having a lash adjustment means that automatically reduces/removes lash from the VVA mechanism.

Moreover, what is needed in the art is a VVA mechanism having an automatic lash adjustment means that substantially reduces and/or eliminates the need for periodic maintenance and/or manual adjustment in order to reduce/remove lash.

SUMMARY OF THE INVENTION

The present invention provides a variable valve actuation mechanism having an automatic lash adjusting means.

The present invention comprises, in one form thereof, an output cam pivotally disposed upon an input shaft. A first link arm is pivotally coupled at a first end thereof to the output cam. A rocker arm is pivotally coupled at a first end thereof to a second end of the link arm. A frame member is pivotally disposed upon the input shaft. Lash adjusting means include an eccentric pin and a force applying means. The eccentric pin pivotally couples together a first end of the frame member and a second end of the rocker arm. The force applying means applies a force upon the eccentric pin causing the eccentric pin to pivot which, in turn, adjusts the position of the rocker arm relative to the input shaft and thereby removes lash from the mechanism.

An advantage of the present invention is that the need for manual adjustment of lash during assembly of a VVA mechanism is substantially reduced.

Another advantage of the present invention is that the need for periodic adjustment/maintenance to reduce/remove lash in the VVA mechanism is substantially reduced.

A further advantage of the present invention is that lash is automatically reduced/removed from the VVA mechanism.

A still further advantage of the present invention is that the need for periodic maintenance and/or manual adjustment of the VVA mechanism in order to reduce/remove lash therefrom is substantially reduced.

BRIEF DESCRIPTION OF THE DRAWINGS

The above-mentioned and other features and advantages of this invention, and the manner of attaining them, will become apparent and be more completely understood by reference to the following description of one embodiment of the invention when read in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENTS

Figure 1:
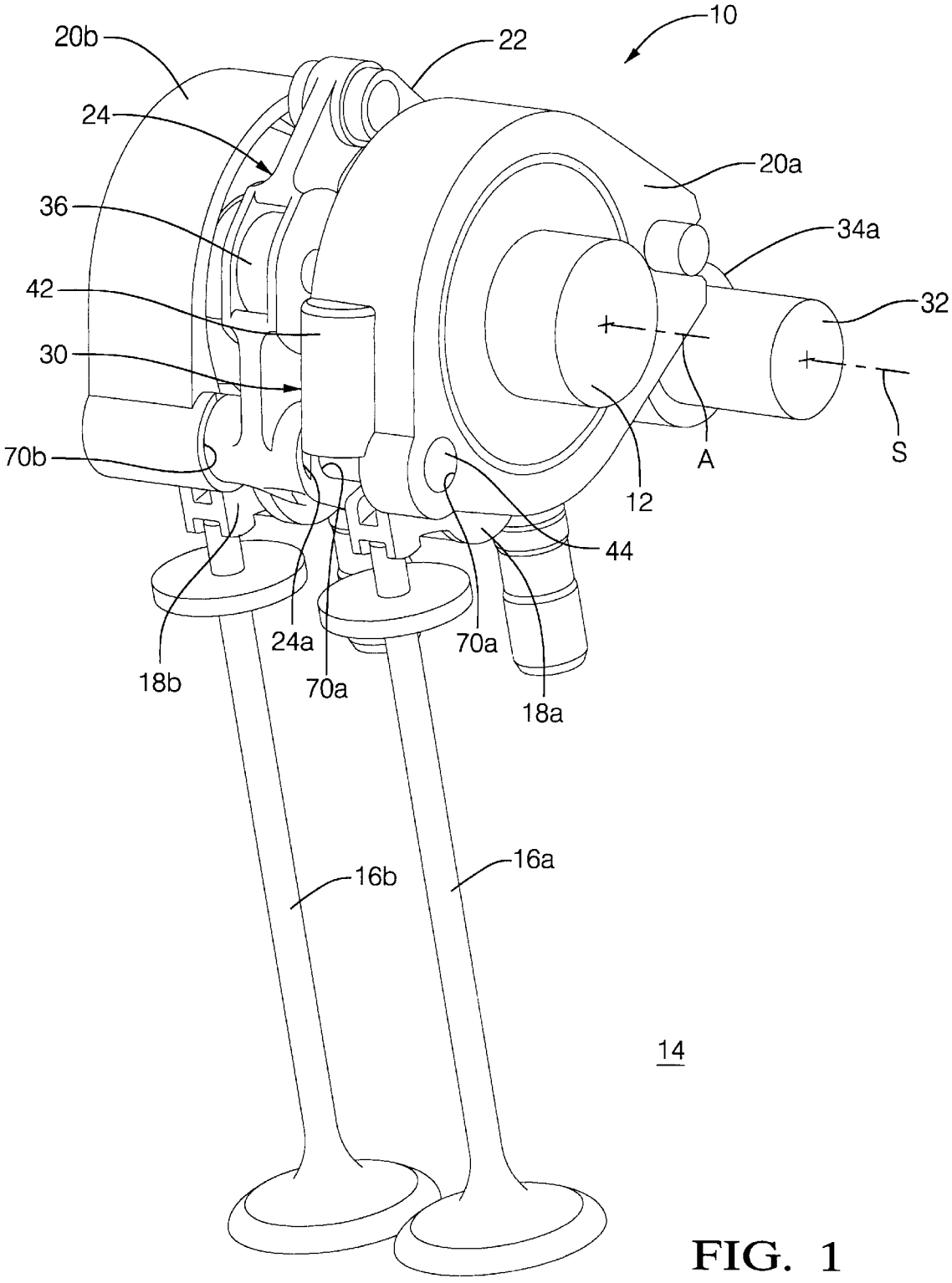
FIG. 1 is a perspective, front view of one embodiment of a variable valve actuating (VVA) mechanism having an automatic lash adjustment means of the present invention.
Figure 2:
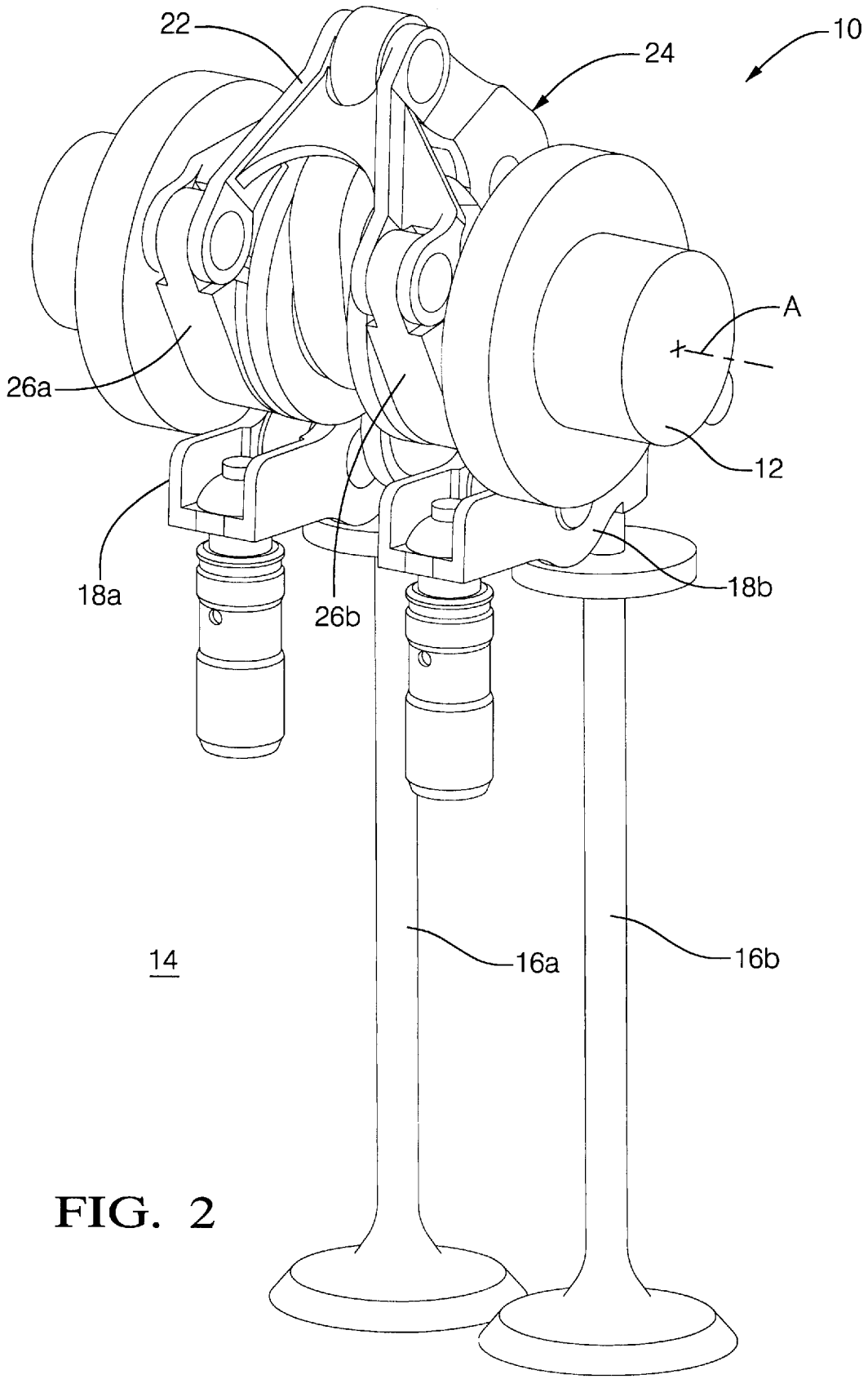
FIG. 2 is a perspective rear view of the VVA mechanism of FIG. 1, with the frame members removed for clarity.

Referring to the drawings, and particularly to FIGS. 1 and 2, there is shown one embodiment of a variable valve actuating (VVA) mechanism having an automatic lash adjustment means of the present invention.

VVA mechanism 10, as is known in the art, is operably associated with rotary input shaft or camshaft 12 (hereinafter referred to as camshaft 12) of engine 14. Camshaft 12 has a central axis A, and includes an input cam lobe and a closing cam lobe (neither of which are shown) that rotate with camshaft 12. Valves 16*a* and 16*b* are associated with a cylinder (not shown) of engine 14 and with respective cam followers 18*a* and 18*b*, such as, for example, roller finger followers.

VVA mechanism 10 includes frame members 20*a* and 20*b*, link arm 22, rocker arm assembly 24, output cams 26*a* and 26*b* (FIG. 2), and automatic lash adjustment means (ALAM) 30. Generally, VVA mechanism 10 transfers rotation of the input cam lobe of camshaft 12 to pivotal oscillation of output cams 26*a* and 26*b* to thereby actuate valves 16*a* and 16*b* according to a desired valve lift profile.

Frame members 20*a* and 20*b* are pivotally disposed on camshaft 12 on respective sides of the input and closing cam lobes thereof. Frame members 20*a* and 20*b*, as will be more particularly described hereinafter, are pivotally coupled at one end (not referenced) thereof to rocker arm assembly 24. Frame members 20*a* and 20*b* are also pivotally coupled at an opposite end (not referenced) thereof to control shaft 32 by respective coupling means 34*a* and 34*b*, such as, for example, shaft clamps.

Link arm 22 is an elongate arm member that is pivotally coupled at a first end (not referenced) thereof to rocker arm assembly 24 and at a second end (not referenced) thereof to output cams 26*a* and 26*b*.

Rocker arm assembly 24 is pivotally coupled, as will be more particularly described hereinafter, at a first end (not referenced) thereof to frame members 20*a*, 20*b*. Rocker arm assembly 24 is pivotally coupled, such as, for example, by a pin, at a second end (not referenced) thereof to link arm 22. Rocker arm assembly 24, as is known in the art, carries an input cam follower 36 and a closing cam follower (not shown), such as, for example, rollers or slider pads (not shown), that engage a corresponding one of the input and closing cams of camshaft 12.

Output cams 26*a* and 26*b* are pivotally disposed upon camshaft 12. More particularly, output cam 26*a* is pivotally disposed upon camshaft 12 on a first side of the input and closing cam lobes thereof and output cam 26*b* is disposed on a second side of the input and closing cam lobes. Output cams 26*a* and 26*b* are pivotally coupled to link arm 22.

In use, VVA mechanism 10 actuates and varies the valve lift of valves 16*a*, 16*b*, in a generally similar manner to that of a conventional VVA mechanism. Generally, VVA mechanism 10 converts rotation of camshaft 12 to a fixed range of pivotal oscillation of output cams 26*a* and 26*b* relative to central axis A. More particularly, as described above, the input cam lobe of camshaft 12 engages the corresponding cam follower (not shown) carried by rocker arm 24. Rotation of the input cam lobe thus displaces rocker arm 24 in a generally radial direction away from central axis A. The displacement of rocker arm 24 is transferred via link arm 22 to pivotal movement of output cams 26*a* and 26*b* in a counterclockwise direction relative to central axis A of camshaft 12.

The closing cam of camshaft 12 is shaped and timed/phased to be the inverse lift of the input or opening cam. The closing cam engages the corresponding cam follower (not shown) carried by rocker arm 24 to return output cams 26*a* and 26*b* to a base or starting angular orientation relative to central axis A of camshaft 12. More particularly, as the input cam lobe rotates from the lift or nose portion of its profile toward a lower lift or base circle portion, the lift portion of the closing cam lobe engages the corresponding cam follower carried by rocker arm 24. The closing cam thereby displaces, or pulls, rocker arm 24 in a generally radial direction toward central axis A of camshaft 12, thereby pivoting (via link arm 22) output cams 26*a* and 26*b* in a clockwise direction and back to their base or starting angular orientation.

A desired valve lift profile for valves 16*a*, 16*b* is obtained by placing control shaft 32 in a predetermined angular orientation relative to central axis S (FIG. 1) thereof. The pivoting of control shaft 32 is transferred via frame members 20*a*, 20*b*, rocker arm 24, and link arm 22 to pivoting of output cams 26*a* and 26*b* relative to central axis A of camshaft 12. Thus, the desired portion of the lift profiles of output cams 26*a* and 26*b* are disposed within the pivotal oscillatory range thereof relative to cam followers 18*a*, 18*b*. As output cams 26*a*, 26*b* are pivotally oscillated, the desired portions of the lift profiles thereof engage cam followers 18*a*, 18*b* to thereby actuate valves 16*a* and 16*b* according to the desired lift profile.

Figure 3:
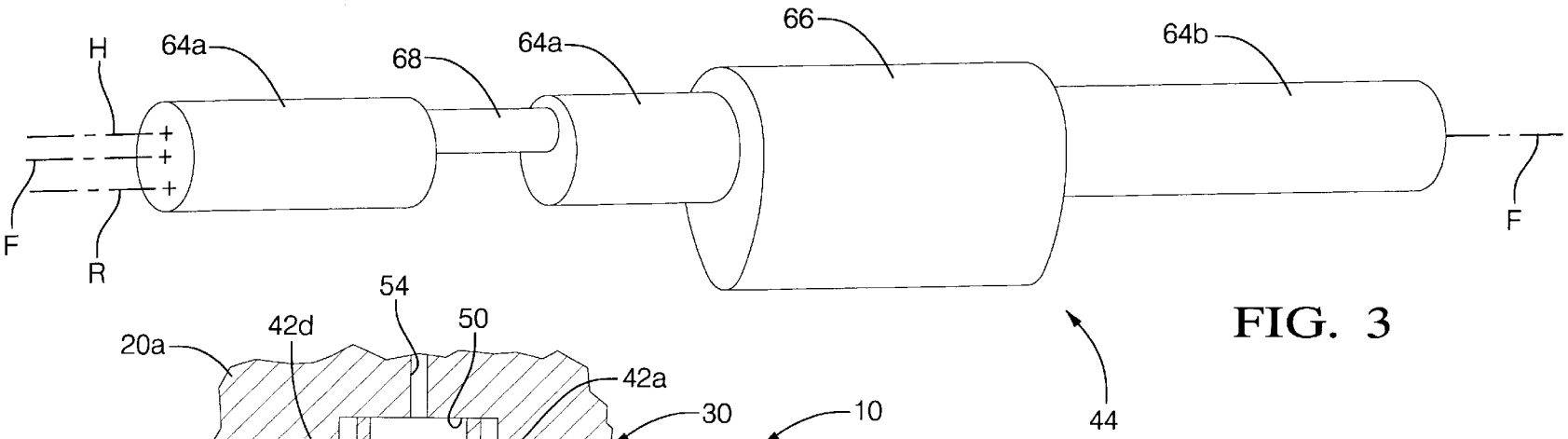
FIG. 3 is a perspective view of the eccentric pin of FIG. 1.
Figure 4:
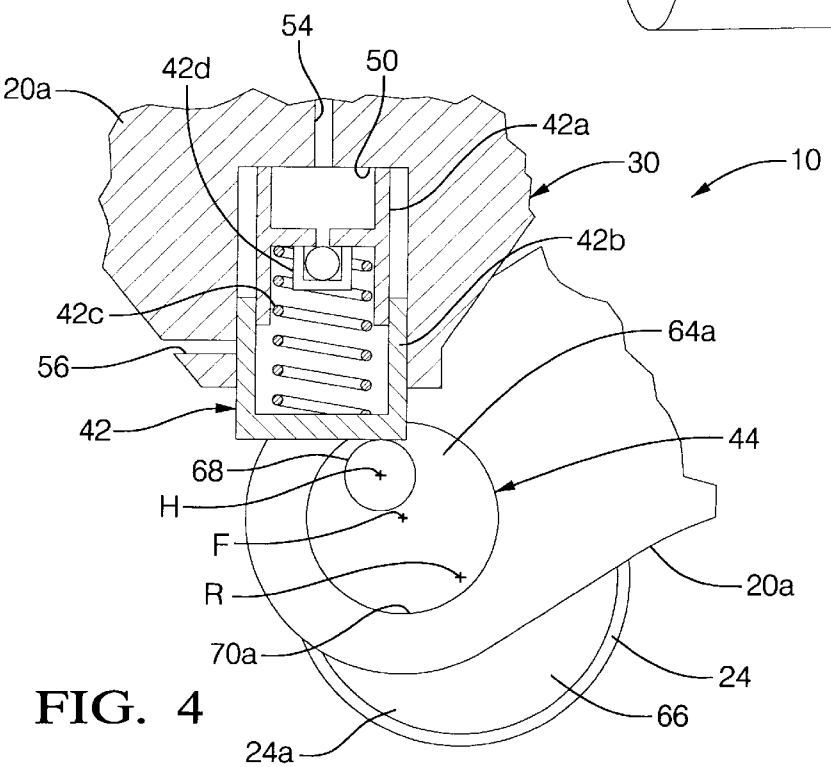
FIG. 4 is a cross-sectional, fragmentary end view of the VVA mechanism of FIG. 1.

Although VVA 10 mechanism actuates and varies the lift profile of valves 16*a* and 16*b* in a manner generally similar to a conventional VVA mechanism, the automatic reduction and/or removal of lash by ALAM 30 distinguishes VVA mechanism 10 relative to a conventional VVA mechanism. ALAM 30, as shown in FIGS. 3 and 4, includes hydraulic element assembly (HEA) 42 and eccentric shaft or pin 44. Generally, eccentric pin 44 pivotally couples frame members 20*a* and 20*b* to rocker arm 24. As is explained in more detail hereinafter, the relative eccentricity of the sections of eccentric pin 44 enables the position of rocker arm 24 to be adjusted in a generally radial direction toward and away from camshaft 12 to thereby adjust and/or reduce lash in VVA mechanism 10. HEA 42 pivotally biases eccentric pin 44 in a direction that reduces the amount of lash in VVA mechanism 10.

HEA 42 is a conventional hydraulic element assembly and is substantially cylindrical. HEA 42 includes cylinder member 42*a*, piston member 42*b*, biasing spring 42*c* and check valve 42*d*. As best shown in FIG. 4, HEA 42 is operably disposed at least partially within and substantially concentric relative to socket 50 that is formed and/or defined in frame member 20*a*. More particularly, HEA 42 is disposed at least partially within socket 50 such that socket 50 surrounds at least a portion of the axial length of HEA 42. Frame member 20*a* defines fluid passageway 54 that defines a path for the flow of fluid, such as, for example, engine oil, through fame member 20*a* and into cylinder 42*a*. Frame member 20*a* also defines pin orifice 56, into and through which a pin member (not shown) extends to retain piston 42*b* of HEA 42 in a retracted or collapsed position during assembly of VVA mechanism 10. Piston 42*b* of HEA 42 is disposed proximate to eccentric pin 44, such that when piston 42*b* is extended from the retracted or collapsed position it engages eccentric pin 44.

Generally, eccentric pin 44 is an elongate pin member that pivotally couples frame members 20*a* and 20*b* to rocker arm assembly 24. As shown in FIGS. 3 and 4, eccentric pin 44 includes first and second frame portions 64*a* and 64*b*, respectively, eccentric rocker section 66 and eccentric HEA section 68.

Frame portions 64*a* and 64*b* are disposed at opposite ends of eccentric pin 44 and have a common centerline F. Frame portion 64*a* includes two substantially coaxial segments (not referenced) that are separated from each other and which are interconnected by HEA section 68. Eccentric rocker section 66 is disposed between frame portions 64*a* and 64*b*, and has centerline R. Eccentric HEA section 68, as stated above, separates and interconnects the two segments of frame portion 64*a*. Eccentric HEA section 68 has centerline H. Centerline R of rocker section 66 is substantially parallel relative to and spaced apart from each of centerlines F and H, and centerline H is substantially parallel relative to and spaced apart from each of centerlines F and R. Centerlines F and H are spaced apart from each other from approximately 0.025 millimeters (mm) to approximately 2.50 mm. Similarly, centerlines F and R are spaced apart from each other from approximately 0.025 millimeters (mm) to approximately 2.50 mm.

Frame portion 64*a* is disposed within frame orifice 70*a* of frame member 20*a*, and pivotally couples frame portion 64*a* to rocker arm assembly 24. Frame orifice 70*a* includes two segments (not referenced) each of which is substantially coaxial relative to the other, and each of which is disposed adjacent a respective outside surface of frame member 20*a*. The respective segments of frame portion 64*a* of eccentric pin 44 that are separated by HEA section 68 are disposed within corresponding segments of frame orifice 70*a*, and eccentric HEA section 68 is disposed between the segments of frame orifice 70*a*. Rocker section 66 of eccentric pin 44 is disposed within bore 24*a* formed through the end of rocker arm assembly 24 opposite the end thereof that is pivotally coupled to link arm 22. Frame portion 64*b* of eccentric pin 44 is disposed within frame orifice 70*b* defined by frame member 20*b*. Thus, eccentric pin 44 pivotally couples together frame members 20*a*, 20*b* and rocker arm assembly 24.

In use, VVA 10 mechanism actuates and varies the lift profile of valves 16*a* and 16*b* as described above and in a generally similar manner to a conventional VVA mechanism. However, VVA mechanism 10 includes ALAM 30, which automatically reduces and/or removes lash from VVA mechanism 10. Generally, ALAM 30 removes lash from VVA mechanism 10 by pivotally biasing eccentric pin 44 into an angular orientation wherein the eccentricity of eccentric pin 44 adjusts the radial position of rocker arm 24 relative to central axis A of camshaft 12 and thereby reduces lash.

Pressurized fluid, such as, for example, engine oil flows into cylinder 42*a* via fluid passageway 54. The fluid flows into piston 42*b* through one-way check valve 42*d*. With the cam followers carried by rocker arm assembly 24 in engagement with the base circle portion of their respective cam lobes, VVA mechanism 10 is in a condition of low applied force. Under this condition of low applied force, piston 42*b* of HEA 42 is biased into contact with HEA section 68 of eccentric pin 44 by biasing spring 42*c*, which exerts a downward (i.e., in the direction of eccentric pin 44) force on cylinder 42*a* and, thus, on HEA section 68 of eccentric pin 44. Under this condition of low applied force, the force applied to piston 42*b* by spring 42*c* is approximately equal to or less than the fluid pressure force within cylinder 42*a*. Thus, check valve 42*d* remains open and enables the fluid to flow from cylinder 42*a* and into piston 42*b*.

The downward force applied to HEA section 68 by HEA 42 imposes a counterclockwise directed torque upon eccentric pin 44 due to the eccentricities of HEA section 68 relative to frame portions 64*a*, 64*b* and rocker section 66. This torque causes eccentric pin 44 to pivot in a counterclockwise direction and thereby removes lash from VVA mechanism 10 by bringing the cam followers carried by rocker arm assembly 24 radially closer to and/or in engagement with the corresponding input and output cams of camshaft 12. Eccentric pin 44 pivots until the cam followers of rocker arm assembly 24 engage their corresponding cams, at which point further counterclockwise pivoting thereof is precluded by the engagement of the followers with the respective cams.

As the input cam and closing cams rotate out of an orientation wherein the base circle portions thereof are in engagement with a corresponding cam follower, and into an orientation wherein a lift portion of the profiles thereof engage a corresponding cam follower, force levels within VVA mechanism 10 are elevated relative to the force levels present in the base circle situation described above. The increased force levels within VVA mechanism 10 tends to pivot eccentric pin 44 in a clockwise direction, which would result in compression of HEA 42. Compression of HEA 42 requires that fluid flow from piston 42*b* into cylinder 42*a* via check valve 42*d*. However, check valve 42*d* substantially precludes fluid from flowing in that direction, i.e., from piston 42*b* into cylinder 42*a*. Thus, HEA 42 is substantially precluded from compressing, i.e., piston 42*b* is substantially precluded from moving in a direction away from eccentric pin 44, and eccentric pin 44 is substantially precluded from pivoting in a clockwise direction. Therefore, any lash within VVA mechanism 10 remains substantially fixed during this elevated force level condition.

It should be particularly noted when force levels within VVA mechanism 10 increase relative to the force levels present in the base circle situation, ALAM 30 is designed to permit a certain amount of fluid to gradually escape from piston 42*b* and into cylinder 42*c*. That is, ALAM 30 is designed with a controlled leakage, provided by, for example, an orifice or dimensional clearances, between piston 42*b* and cylinder 42*c*. Accordingly, under such increased or high-force conditions, piston 42*b* retracts slightly, and eccentric pin 44 pivots slightly, in a lash-increasing direction thereby slightly increasing the amount of lash within VVA mechanism 10. This slight increase in the lash is necessary to compensate for thermal expansion of the components within VVA mechanism 10.

It should also be particularly noted that during assembly and prior to use of VVA mechanism 10, a pin member is inserted into and extends through pin orifice 56 formed in frame member 20*a*. The pin member retains HEA assembly 42 in position within socket 50, and retains piston 42*b* in a retracted position within socket 50, thereby facilitating assembly and installation of VVA mechanism 10. The pin is removed once VVA mechanism 10 is assembled and installed within engine 14.

It should further be particularly noted that optional bearings can be disposed between eccentric pin 44 and each of frame members 20*a* and 20*b* and rocker arm assembly 24 to reduce friction at those interfaces.

In the embodiment shown, frame members 20*a*, 20*b* are configured as separate frame members. However, it is to be understood that the present invention can be alternately configured, such as, for example, with interconnected frame members or a single integral frame member. The use of an integral frame member assists in maintaining the concentricity of the frame bores within which the eccentric pin is disposed.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed is:

1. A variable valve actuating mechanism, comprising:

an output cam configured for being pivotally disposed upon an input shaft;

a first link arm pivotally coupled at a first end thereof to said output cam;

a rocker arm pivotally coupled at a first end thereof to a second end of said link arm;

a first frame member configured for being pivotally disposed upon the input shaft on a first side of input and output cams disposed thereon; and lash adjusting means including an eccentric pin and a force applying means, said eccentric pin pivotally coupling together a first end of said first frame member and a second end of said rocker arm, said force applying means configured for applying a force upon said eccentric pin to thereby pivot said eccentric pin and adjust a position of said rocker arm relative to the input shaft.

2. The variable valve actuating mechanism of claim 1, wherein said eccentric pin comprises:

a first frame portion pivotally associated with said first frame member, said first frame portion having a first frame portion centerline;

a rocker section pivotally associated with said rocker, said rocker section having a rocker section centerline, said rocker section centerline being substantially parallel relative to and spaced apart from said first frame portion centerline; and an eccentric section having an eccentric section centerline, said eccentric section centerline being substantially parallel relative to and spaced apart from said first frame portion centerline and said rocker section centerline, said eccentric section configured for being engaged by said force applying means.

3. The variable valve actuating mechanism of claim 2, wherein said rocker section is immediately adjacent to and adjoins said first frame portion.

4. The variable valve actuating mechanism of claim 2, wherein said first frame portion includes first and second segments, said eccentric section disposed between and connecting together said first and second segments.

5. The variable valve actuating mechanism of claim 2, further comprising:

a second frame member configured for being pivotally disposed upon the input shaft on a side of the input and output cams that is opposite said first frame member; and said eccentric pin having a second frame portion, said second frame portion being substantially concentric relative to said first frame portion centerline, said first frame portion being immediately adjacent to and adjoining a first end of said rocker section, said second frame portion being immediately adjacent to and adjoining a second end of said rocker section, said second frame portion pivotally associated with said second frame member.

6. The variable valve actuating mechanism of claim 5, wherein said first frame portion includes first and second segments, said eccentric portion being disposed between and connecting together said first and second segments.

7. The variable valve actuating mechanism of claim 2, wherein said first frame portion centerline and said rocker section centerline are separated by from approximately 0.025 millimeters (mm) to approximately 2.5 mm.

8. The variable valve actuating mechanism of claim 2, wherein said first frame portion centerline and said eccentric section centerline are separated by from approximately 0.025 millimeters (mm) to approximately 2.5 mm.

9. The variable valve actuating mechanism of claim 2, wherein said second end of said rocker arm defines a rocker arm bore therethrough, said rocker section being disposed at least partially within said rocker arm bore, said first frame portion defining a first frame orifice extending through a first end of said first frame member, said first frame portion being disposed at least partially within said first frame orifice.

10. The variable valve actuating mechanism of claim 2, further comprising:

a second frame member having a first end, said first end defining a second frame bore therethrough, said second frame member configured for being pivotally disposed upon the input shaft; and wherein said eccentric pin includes a second frame portion substantially concentric relative to said first frame portion centerline, said second frame portion adjoining said rocker section at an end thereof opposite to said first frame section, said second frame portion being pivotally disposed at least partially within said second frame bore.

11. The variable valve actuating mechanism of claim 2, wherein said force applying means comprises a hydraulic element assembly.

12. The variable valve actuating mechanism of claim 11, wherein said first frame member defines a socket therein, said hydraulic element assembly being disposed at least partially within said socket.

13. The variable valve actuating mechanism of claim 12, wherein said socket is in fluid communication with a supply of pressurized fluid, said hydraulic element assembly being disposed within said socket and in communication with said supply of pressurized fluid.

14. The variable valve actuating mechanism of claim 12, wherein said first frame member defines a pin orifice extending from an outside surface thereof and into said socket.

15. An internal combustion engine, comprising:

an input shaft; and a variable valve actuating mechanism, including:

an output cam configured for being pivotally disposed upon an input shaft;

a first link arm pivotally coupled at a first end thereof to said output cam;

a rocker arm pivotally coupled at a first end thereof to a second end of said link arm;

a first frame member configured for being pivotally disposed upon the input shaft; and lash adjusting means including an eccentric pin and a force applying means, said eccentric pin pivotally coupling together a first end of said first frame member and a second end of said rocker arm, said force applying means applying a force upon said eccentric pin to thereby pivot said eccentric pin and adjust a position of said rocker arm relative to the input shaft.

16. The internal combustion engine of claim 15, wherein said eccentric pin comprises:

a first frame portion pivotally associated with said frame, said first frame portion having a first frame portion centerline;

a rocker section pivotally associated with said rocker, said rocker section having a rocker section centerline, said rocker section centerline being substantially parallel relative to and spaced apart from said first frame portion centerline; and an eccentric section having an eccentric section centerline, said eccentric section centerline being substantially parallel relative to and spaced apart from said first frame portion centerline and said rocker section centerline, said eccentric section configured for being engaged by said force applying means.

17. The internal combustion engine of claim 16, wherein said first frame portion centerline and said rocker section centerline are separated by from approximately 0.025 millimeters (mm) to approximately 2.5 mm.

18. The variable valve actuating mechanism of claim 16, wherein said first frame portion centerline and said eccentric section centerline are separated by from approximately 0.025 millimeters (mm) to approximately 2.5 mm.

19. The variable valve actuating mechanism of claim 16, wherein said second end of said rocker arm defines a rocker arm bore therethrough, said rocker section being disposed at least partially within said rocker arm bore, said first frame portion defining a first frame orifice extending through a first end of said first frame member, said first frame portion being disposed at least partially within said first frame orifice.

20. The variable valve actuating mechanism of claim 19, further comprising:

a second frame member having a first end, said first end defining a second frame bore therethrough, said second frame member configured for being pivotally disposed upon the input shaft; and wherein said eccentric pin includes a second frame portion substantially concentric relative to said first frame portion centerline, said second frame portion adjoining said rocker section at an end thereof opposite to said first frame section, said second frame portion being pivotally disposed at least partially within said second frame bore.

21. The variable valve actuating mechanism of claim 16, wherein said force applying means comprises a hydraulic element assembly.

* * * * *